US005301609A

United States Patent [19]

Guaraldi et al.

[11] Patent Number: 5,301,609

[45] Date of Patent: Apr. 12, 1994

[54] PRINTING UNIT WITH SKEW AND THROW-OFF MECHANISMS

[75] Inventors: Glenn A. Guaraldi, Kingston, N.H.; James W. Geary, Darien, Conn.

[73] Assignee: Heidelberg Harris Inc., Dover, N.H.

[21] Appl. No.: 26,505

[22] Filed: Mar. 4, 1993

[51] Int. Cl.[5] ..... B41F 5/00

[52] U.S. Cl. ..... 101/216; 101/139; 101/143; 101/247

[58] Field of Search ..... 101/216, 217, 218, 147, 101/148, 247, 248, 191, 192, 152, 153, 136, 138, 139, 140, 141, 143, 145, 283

[56] References Cited

U.S. PATENT DOCUMENTS

| | | | |
|---|---|---|---|
| 906,484 | 12/1908 | Ballard | 101/247 |
| 3,633,503 | 1/1972 | Tafel | 101/139 |
| 4,214,527 | 7/1980 | Kamota | 101/247 |
| 4,365,552 | 12/1982 | Kubert | 101/218 |
| 4,414,895 | 11/1983 | Schwartz et al. | 101/247 |
| 4,453,463 | 6/1984 | Dahlgren et al. | 101/148 |
| 4,458,590 | 7/1984 | Egnaczak | 101/247 |
| 4,458,591 | 7/1984 | Guaraldi | 101/247 |
| 4,643,090 | 2/1987 | McKrell et al. | 101/218 |
| 4,831,926 | 5/1989 | Bowman et al. | 101/138 |

*Primary Examiner*—Eugene H. Eickholt

*Attorney, Agent, or Firm*—Tarolli, Sundheim & Covell

[57] ABSTRACT

A printing unit (10) includes a frame (22), first and second brackets (50, 54), and upper and lower plate cylinders (14, 18). The first bracket (50) is supported on the frame (22) for movement relative to the frame (22). The upper plate cylinder (14) has an end supported to move with the first bracket (50). The second bracket (54) also is supported on the frame (22) for movement relative to the frame (22), and the lower plate cylinder (18) has an end supported to move with the second bracket (54). The printing unit (10) also includes a skewing mechanism and a throw-off mechanism. The skewing mechanism moves the brackets (50, 54) transversely relative to the frame (22) independently of each other. The throw-off mechanism moves the brackets (50, 54) pivotally relative to the frame (22). The throw-off mechanism includes a pressure cylinder (140) and a piston rod (142) connected between the two brackets (50, 54) The pressure cylinder and the piston rod (142) are pivotally connected to the brackets (50, 54) and move pivotally relative to the brackets (50, 54) when the brackets (50, 54) are moved transversely by the skewing mechanism. The throw-off mechanism thus permits the brackets (50, 54) to be skewed independently of each other while remaining connected with each other for throw-off.

16 Claims, 3 Drawing Sheets

PRINTING UNIT WITH SKEW AND THROW-OFF MECHANISMS

FIELD OF THE INVENTION

The present invention relates to a printing unit with rotatable printing cylinders.

BACKGROUND OF THE INVENTION

A printing unit has a plurality of rotatable printing cylinders. An offset printing unit, for example, has a plate cylinder and a blanket cylinder. The plate cylinder and the blanket cylinder are supported at their opposite ends for rotation in the frame of the printing unit. The plate cylinder carries a printing plate having a surface on which an inked image is defined. The blanket cylinder carries a printing blanket. When the cylinders rotate in the printing unit, the plate on the plate cylinder transfers the inked image to the blanket on the blanket cylinder at a nip between the plate cylinder and the blanket cylinder. The blanket on the blanket cylinder subsequently transfers the inked image to the material being printed, such as a web of paper.

A printing unit typically includes a skew mechanism to skew the plate cylinder relative to the blanket cylinder. When the plate cylinder is skewed relative to the blanket cylinder, the angular position of the plate on the plate cylinder is changed relative to the blanket on the blanket cylinder. The angular position of the inked image which is transferred from the plate to the blanket, and subsequently to the web, is likewise changed. The alignment of the image with the web is thus adjusted by adjusting the skew mechanism.

An offset printing unit also includes a throw-off mechanism. When the printing plate and/or the printing blanket are to be serviced or replaced, the cylinders are moved relative to each other into thrown-off positions. When the cylinders are in their thrown-off positions, they are spaced from each other to permit access to the printing plate, the printing blanket and the web.

SUMMARY OF THE INVENTION

In accordance with the present invention, a printing unit comprises a frame, first and second brackets, and first and second printing cylinders. The first bracket is supported on the frame for movement relative to the frame. The first printing cylinder has an end supported to move with the first bracket. The second bracket also is supported on the frame for movement relative to the frame. The second printing cylinder has an end supported to move with the second bracket.

The printing unit further comprises a skewing means and a throw-off means. The skewing means changes the angular positions of the first and second printing cylinders. The skewing means includes means for moving the first bracket relative to the frame, and includes means for moving the second bracket relative to the frame independently of movement of the first bracket.

The throw-off means moves the first and second printing cylinders toward and away from each other. The throw-off means includes motor means for moving the first and second brackets relative to the frame. The motor means is connected between the first and second brackets. The motor means includes a first output member which is connected to the first bracket, a second output member which is connected to the second bracket, and a means for moving the first and second output members relative to each other.

In a preferred embodiment of the present invention, the first printing cylinder is an upper plate cylinder and the second printing cylinder is a lower plate cylinder. An upper blanket cylinder is located adjacent to the upper plate cylinder. A lower blanket cylinder is located adjacent to the lower plate cylinder. When the skewing means moves the first bracket relative to the frame, the upper plate cylinder is skewed relative to the upper blanket cylinder. When the skewing means moves the second bracket relative to the frame, the lower plate cylinder is skewed relative to the lower blanket cylinder.

The first output member in the motor means is a pressure cylinder. The second output member in the motor means is a piston rod which is movable in the pressure cylinder in response to pressure in the pressure cylinder. The pressure cylinder is pivotally connected to the first bracket, and the piston rod is pivotally connected to the second bracket. When the pressure cylinder is pressurized to cause the piston rod to move, the brackets are moved relative to each other for throw-off. Additionally, the pressure cylinder and the piston rod move pivotally relative to the brackets when the brackets are moved by the skewing means. The throw-off means is thus associated with the brackets in a manner which permits the brackets to be skewed independently of each other while remaining connected to each other by the throw-off means.

Further in accordance with the present invention, the skewing means includes a hub and a support member. The hub supports the first bracket to pivot about a hub axis. The support member supports the first bracket to move in a direction transverse to the hub axis in sliding contact with the support member. The skewing means pivots the first bracket about the hub axis and simultaneously moves the first bracket transversely in sliding contact with the support member.

In the preferred embodiment of the present invention, the first bracket moves the end of the upper plate cylinder along a circular path centered on the axis of rotation of the upper blanket cylinder when the first bracket is pivoted about the hub axis and is simultaneously moved transversely in sliding contact with the support member. The support member preferably is a wedge which is movable transversely against the first bracket to adjust the pressure between the first and second brackets, and thereby to adjust the surface pressure between the printing plate and the printing blanket at the nip between the upper plate cylinder and the upper blanket cylinder. Similar wedges are located between the other printing cylinders.

The preferred embodiment of the present invention further includes a third bracket supporting the end of the lower blanket cylinder. The weight of the third bracket is supported on the second bracket so that the third bracket is carried downward by the second bracket when the second bracket is moved downward by the piston rod. The third bracket, and the lower blanket cylinder which is supported on the third bracket, thus drop downward to a thrown-off position under the influence of gravity when the second bracket and the lower plate cylinder are moved into thrown-off positions by the piston rod.

BRIEF DESCRIPTION OF THE DRAWINGS

The foregoing and other features of the present invention will become apparent to those skilled in the art upon reading the following description of a preferred embodiment of the invention in view of the accompanying drawings, wherein.

DESCRIPTION OF A PREFERRED EMBODIMENT

Figure 1:
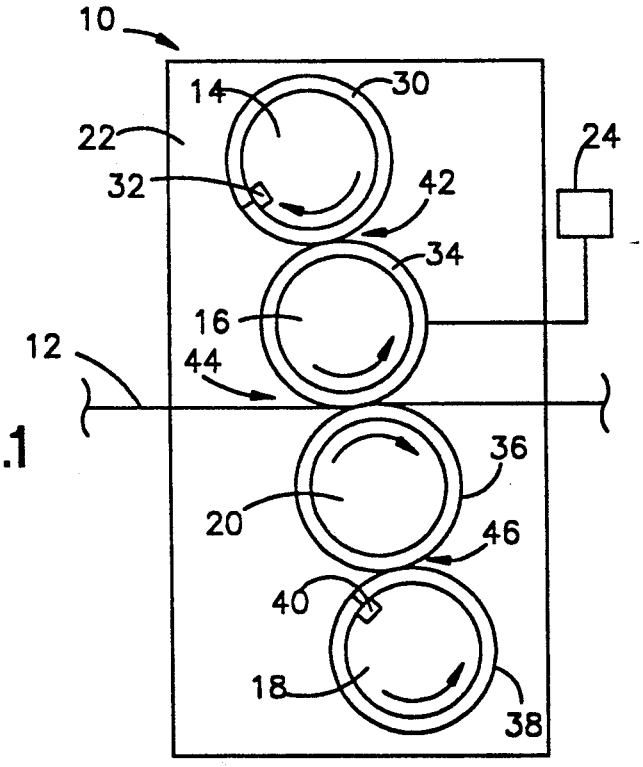
FIG. 1 is a schematic view of a printing unit constructed in accordance with the present invention.

A printing unit 10 constructed in accordance with the present invention is shown schematically in FIG. 1. The printing unit 10, by way of example, is an offset lithographic printing unit for printing on opposite sides of a web 12. The printing unit 10 includes an upper plate cylinder 14 and an upper blanket cylinder 16 above the web 12, and a lower plate cylinder 18 and a lower blanket cylinder 20 below the web 12. The cylinders 14–20 are supported for rotation by a frame having a pair of side walls 22, one of which is shown in FIG. 1. A motor 24 drives a gear train (not shown) which is connected to the cylinders 14–20 to rotate the cylinders 14–20 as indicated by the arrows shown in FIG. 1. The motor 24 and the gear train can be constructed as known in the art.

The upper plate cylinder 14 carries a printing plate 30 which defines an image to be printed. The printing plate 30 is formed as a thin metal sheet, and is mounted on the upper plate cylinder 14 by wrapping the sheet around the upper plate cylinder 14. A locking mechanism 32 in the upper plate cylinder 14 holds the printing plate 30 securely on the upper plate cylinder 14. The upper blanket cylinder 16 carries a printing blanket 34. The printing blanket 34 is formed as a tube which is mounted on the upper blanket cylinder 16 by sliding the tube telescopically over the upper blanket cylinder 16. Another tubular printing blanket 36 is similarly mounted on the lower blanket cylinder 20, and another printing plate 38 is held on the lower plate cylinder 18 by a locking mechanism 40.

When the cylinders 14–20 are being rotated by the motor 24 and the gear train, ink is supplied to both of the printing plates 30 and 38 to form inked images on the printing plates 30 and 38. The inked image on the upper printing plate 30 is transferred to the upper printing blanket 34 at the nip 42 between the upper plate cylinder 14 and the upper blanket cylinder 16. The upper printing blanket 34 subsequently transfers the inked image to the upper side surface of the web 12 at the nip 44 between the upper and lower blanket cylinders 16 and 20. The lower printing plate 38 transfers its inked image to the lower printing blanket 36 at the nip 46 between the lower plate cylinder 18 and the lower blanket cylinder 20. The lower printing blanket 36 subsequently transfers the inked image to the lower side surface of the web 12 at the nip 44. The printing unit 10 thus prints simultaneously on opposite sides of the web 12.

Figure 2:
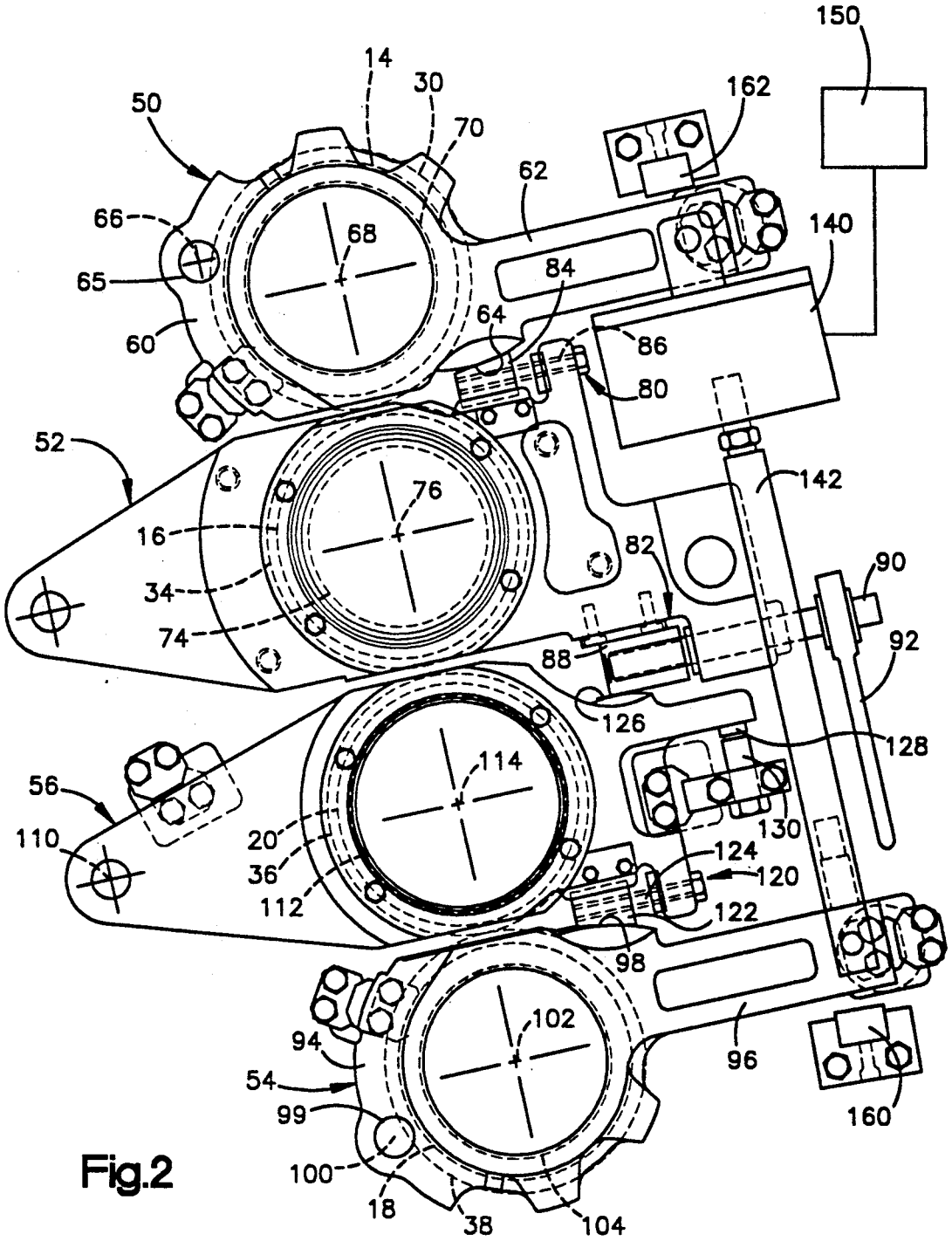
FIG. 2 is a view of parts of the apparatus of FIG. 1.

As shown in FIG. 2, the printing unit 10 further includes a plurality of brackets mounted on a side wall 22 at one end of the printing cylinders 14–20. A first bracket 50 is associated with the upper plate cylinder 14. A second bracket 52 is associated with the upper blanket cylinder 16. A third bracket 54 is associated with the lower plate cylinder 18, and a fourth bracket 56 is associated with the lower blanket cylinder 20. The brackets 50–54 are movable relative to each other for throw-off and skewing of the printing cylinders 14–20. A similar set of brackets is associated with the opposite ends of the printing cylinders 14–20 on the other side wall 22. The other brackets are movable relative to each other for throw-off, but not for skewing, as described below.

The first bracket 50 has a generally circular main portion 60 and an elongated arm portion 62 extending horizontally from the main portion 60. The arm portion 62 of the first bracket 50 has an arcuate lower surface 64 facing the second bracket 52. The main portion 60 of the first bracket 50 is mounted on a hub 65 on the side wall 22. The hub 65 defines an upper throw-off axis 66. The first bracket 50 is movable relative to the side wall 22 pivotally about the upper throw-off axis 66.

The upper plate cylinder 14 has a central axis 68, and is supported in a bearing 70 to rotate about the axis 68. The bearing 70 is supported on the main portion 60 of the first bracket 50 to move with the first bracket 50 relative to the side wall 22. The upper plate cylinder 14 is thus supported by the first bracket 50 to move with the first bracket 50 relative to the side wall 22.

The second bracket 52 is fixed to the side wall 22. The second bracket 52 supports a bearing 74 in which the upper blanket cylinder 16 is rotatable about its central axis 76. The upper blanket cylinder 16 is thus supported on the side wall 22 by the second bracket 52 with the axis 76 being fixed relative to the side wall 22.

The second bracket 52 also supports a first wedge assembly 80 and a second wedge assembly 82. The first wedge assembly 80 includes a first wedge 84 and a threaded rod 86. The rod 86 extends through a clearance bore in the second bracket 52. The first wedge 84 is mounted on the rod 86, and is movable horizontally relative to the second bracket 52 upon rotation of the rod 86 relative to the second bracket 52. The second wedge assembly 82 similarly includes a second wedge 88 and a threaded rod 90 extending through a clearance bore in the second bracket 52. The second wedge 88 is movable horizontally with the rod 90 relative to the second bracket 52 upon rotation of the rod 90 relative to the second bracket 52. A handle 92 is mounted on the rod 90 for rotating the rod 90.

The third bracket 54 is similar to the first bracket 50. The third bracket 54 has a generally circular main portion 94 and an elongated arm portion 96 extending horizontally from the main portion 94. The arm portion 96 of the third bracket 54 has an arcuate upper surface 98 facing the fourth bracket 56. The main portion 94 of the third bracket 54 is mounted on a hub 99 on the side wall 22. The hub 99 defines a lower throw-off axis 100. The third bracket 54 is movable relative to the side wall 22 pivotally about the lower throw-off axis 100.

The lower plate cylinder 18 has a central axis 102, and is supported in a bearing 104 to rotate about the axis 102. The bearing 104 is supported on the main portion 94 of the third bracket 54 to move with the third bracket 54 relative to the side wall 22. The lower plate cylinder 18 is thus supported by the third bracket 54 to move with the third bracket 54 relative to the side wall 22.

The fourth bracket 56 is supported on the side wall 22 to move relative to the side wall 22 pivotally about an intermediate throw-off axis 110. The fourth bracket 56 supports a bearing 112 in which the lower blanket cylinder 20 is rotatable about its central axis 114 The lower blanket cylinder 20 is thus supported by the fourth bracket 56 to move with the fourth bracket 56 relative to the side wall 22.

The fourth bracket 56 also supports a third wedge assembly 120. The third wedge assembly 120 is like the first wedge assembly 80, and includes a third wedge 122 mounted on a threaded rod 124 for horizontal movement with the rod 124 relative to the fourth bracket 56. The fourth bracket 56 further has an arcuate upper surface 126 facing the second bracket 52, and has a stop surface 128. The stop surface 128 faces an adjustable stopper 130 on the side wall 22.

A pressure cylinder 140 is pivotally connected to the first bracket 50 near the outer end of the arm portion 62, as shown in FIG. 2. A piston rod 142 extending from the pressure cylinder 130 is pivotally connected to the third bracket 54 near the outer end of the arm portion 96. A throw-off control means 150, shown schematically in FIG. 2, controls the pressure in the pressure cylinder 140. The throw-off control means 150 can comprise any suitable device which can be selectively actuated by an operator of the printing unit 10 to cause the piston rod 142 to move into and out of the pressure cylinder 140 as desired.

When the printing unit 10 is operating to print on the web 12 as shown in FIG. 1, the brackets 50–56 take the positions shown in FIG. 2. The arcuate lower surface 64 on the first bracket 50 lies on the first wedge 84 on the second bracket 52. The upper printing plate 30 on the upper plate cylinder 14 is then pressed against the upper printing blanket 34 on the upper blanket cylinder 16 in ink transferring relationship with the upper printing blanket 34.

The pressure between the surfaces of the upper printing plate 30 and the upper printing blanket 34 at the nip 42 (FIG. 1) can be adjusted by adjusting the horizontal position of the first wedge 84 between the first and second brackets 50 and 52. Specifically, the surface pressure at the nip 42 can be decreased by moving the first wedge 84 to the left as viewed in FIG. 2. The first wedge 84 would then exert a relatively greater force urging the first and second brackets 50 and 52 apart. The force exerted by the first wedge 84 would also urge the upper plate cylinder 14 and the upper blanket cylinder 16 apart, and would thereby counteract and decrease the surface pressure at the nip 42. The surface pressure at the nip 42 could likewise be increased by moving the first wedge 84 to the right, as viewed in FIG. 2.

When the third bracket 54 takes the position shown in FIG. 2, the arcuate upper surface 98 on the arm portion 96 abuts the third wedge 122 on the fourth bracket 56. The third bracket 54 is held in that position by the pressure cylinder 140 and the piston rod 142. The third bracket 54 in turn holds the fourth bracket 56 in its position, with the arcuate upper surface 126 on the fourth bracket 56 abutting the second wedge 88 on the second bracket 52. The lower printing plate 38 and the lower printing blanket 36 are then pressed together in ink-transferring relationship with each other at the nip 46. Additionally, the lower printing blanket 36 and the upper printing blanket 34 are located in ink-transferring relationship with respective opposite side surfaces of the web 12 at the nip 44, and are thus effectively pressed against each other at the nip 44.

As with the surface pressure at the nip 42, the surface pressures at the nips 44 and 46 can be adjusted by adjusting the horizontal positions of the second and third wedges 88 and 122. In accordance with this feature of the present invention, the printing unit 10 does not include bearers on the printing cylinders which, in a conventional printing unit, control the surface pressures at the nips between the printing cylinders. In the printing unit 10, the surface pressures at the nips 42, 44 and 46 are controlled by the adjustable wedge assembles 80, 82 and 120 for a given condition of the pressure cylinder 140 and the piston rod 142.

When a printing operation is stopped, the printing cylinders 14–20 are thrown-off from each other. The throw-off control means 150 is actuated to pressurize the pressure cylinder 140 so as to cause the piston rod 142 to move out of the pressure cylinder 140. The piston rod 142 then moves downward as viewed in FIG. 2, and moves the third bracket 54 pivotally about the lower throw-off axis 100 in a clockwise direction. The weight of the fourth bracket 56, as well as approximately half the weight of the lower blanket cylinder 20 and the lower printing blanket 36, is supported on the third bracket 54 where the third wedge 122 lies on the arcuate upper surface 98. The fourth bracket 56 is thus supported to be carried downward by the third bracket 54, i.e., to drop downward under the influence of gravity, when the third bracket 54 is moved downward by the piston rod 142. The fourth bracket 56 is thus moved by gravity pivotally about the intermediate throw-off axis 110 in a clockwise direction away from the second bracket 52. The fourth bracket 56 falls away from the second bracket 52 in this manner until the stop surface 128 meets the stopper 130 on the side wall 22. The fourth bracket 56 is thus allowed to drop into its thrown-off position in which it is spaced from the second bracket 52. The third bracket 54 thereafter moves pivotally away from the fourth bracket 56 upon further downward movement of the piston rod 142. The third bracket 54 moves away from the fourth bracket 56 until the arm portion 96 of the third bracket 54 meets a lower block 160 on the side wall 22. The third bracket 54 is thus moved into its thrown-off position in which it is spaced from the fourth bracket 56.

After pivotal movement of the third bracket 54 is stopped by the lower block 160, the pressure cylinder 140 is further pressurized so as to cause the pressure cylinder 140 to move upward as shown in FIG. 2. The first bracket 50 is thus moved pivotally about the upper throw-off axis 66 in a counterclockwise direction. Such movement of the first bracket 50 continues until the arm portion 62 of the first bracket 50 meets an upper block 162 on the side wall 22. The first bracket 50 is thus moved into its thrown-off position in which it is spaced from the second bracket 52.

When the brackets 50, 54 and 56 have been moved into their thrown-off positions, the printing cylinders 14–20 are spaced from each other across the nips 42, 44 and 46 sufficiently to provide access to the respective printing plates and printing blankets. When printing is to resume, the brackets 50, 54 and 56 and the cylinders 14, 18 and 20 are moved back into their operating positions upon a reversal of the foregoing sequence of movements under the influence of the throw-off control means 150. As noted above, a similar set of brackets at the opposite ends of the printing cylinders 14–20 operates in the same way for throw-off of the printing cylinders 14–20.

Figure 3:
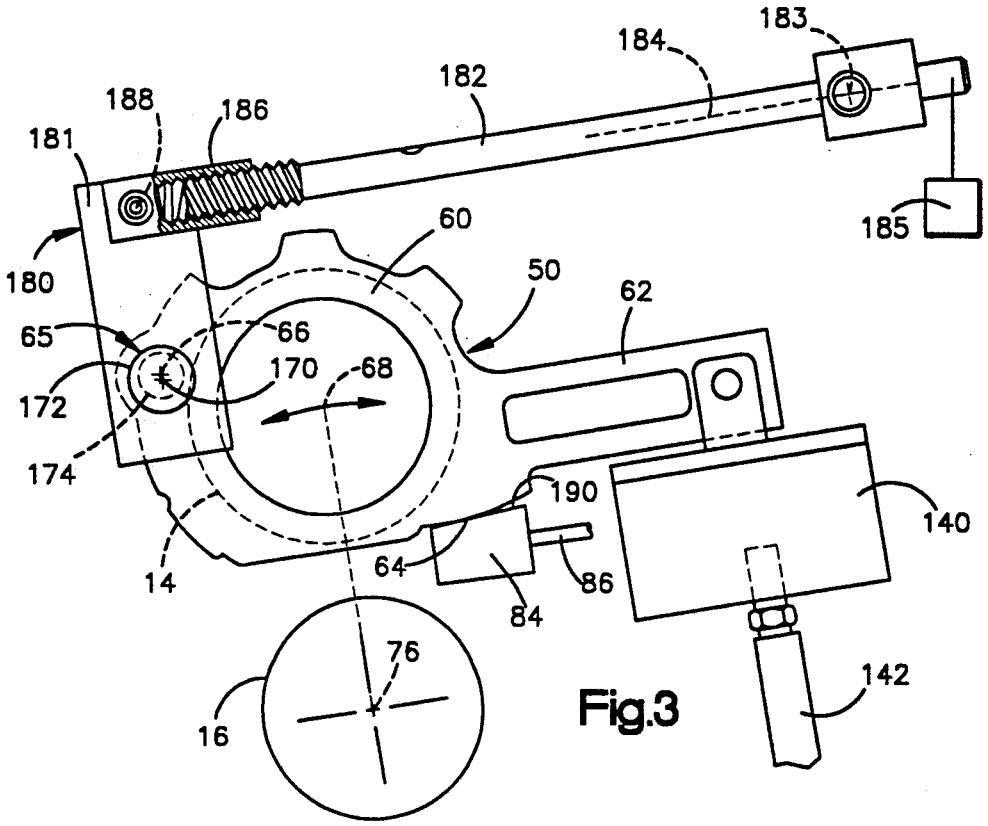
FIG. 3 is a view of parts of the apparatus of FIG. 1.

The printing unit 10 further includes means for skewing the upper and lower plate cylinders 14 and 18. As shown in FIG. 3, the hub 65 defines an upper skew axis 170 in addition to the upper throw-off axis 66. The hub 65 has a main portion 172 and an eccentric portion 174. The upper skew axis 170 is the central axis of the main portion 172. The upper throw off axis 66 is the central axis of the eccentric portion 174. The main portion 172 of the hub 65 is supported in the side wall 22 to rotate relative to the side wall 22 about the upper skew axis 170. When the main portion 172 rotates about the upper skew axis 170, the eccentric portion 174 also rotates about the upper skew axis 170. The upper throw-off axis 66 on the eccentric portion 174 then moves to the right or the left, as viewed in FIG. 3, along a circular path centered on the upper skew axis 170.

A skew adjusting mechanism 180 includes lever 181 and an adjusting bar 182. The lever 181 and the adjusting bar 182 are connected between the side wall 22 and the main portion 172 of the hub 65. The lever 181 and the main portion 172 of the hub 65 are connected to each other to rotate together about the upper skew axis 170. One end portion of the adjusting bar 182 is supported on the side wall 22 to move relative to the side wall 22 pivotally about an axis 183, and also to rotate about its own longitudinal axis 184 under the influence of a motor 185. The other end of the adjusting bar 182 is externally threaded, and is received in an internally threaded sleeve 186. The sleeve 186 is connected to the lever 181 to move relative to the lever 181 pivotally about an axis 188. When the adjusting bar 182 is rotated in the sleeve 186, it moves relatively into or out of the sleeve 186. The adjusting bar 182 then moves the sleeve 186 to the right or to the left as viewed in FIG. 3. Such movement of the sleeve 186 rotates the lever 180 and the hub 65 about the upper skew axis 170.

The first bracket 50 is supported on the eccentric portion 174 of the hub 65 to rotate about the eccentric portion 174. The first bracket 50 is thus supported on the hub 65 to move relative to the side wall 22 pivotally about the upper throw-off axis 66, as described above with reference to FIG. 2. When the hub 65 rotates about the upper skew axis 170 under the influence of the adjusting bar 182, the main portion 60 of the first bracket 50 moves rotationally about the upper skew axis 170 with the eccentric portion 174 of the hub 65. The main portion 60 of the first bracket 50 then moves to the right or the left as does the axis 66 of the eccentric portion 174. The arm portion 62 of the first bracket 50 moves to the right or the left in sliding contact with the upper surface 190 of the first wedge 84 where the arcuate lower surface 64 rests on the upper surface 190. The first bracket 50 thus moves transversely relative to the upper blanket cylinder 14. The end of the upper plate cylinder 14 that is supported by the first bracket 50 moves transversely with the first bracket 50. The opposite end of the upper plate cylinder 14 does not move transversely with the first bracket 50. The angular position of the axis 68 of the upper plate cylinder 14 is therefore skewed relative to the axis 76 of the upper blanket cylinder 16 when the first bracket 50 is moved transversely relative to the blanket cylinder 16. The amount that the upper plate cylinder 14 is skewed is controlled by the amount that the adjusting bar 182 is rotated by the motor 185 to rotate the hub 65 about the upper skew axis 170.

As noted above, the axis 66 of the eccentric portion 174 of the hub 65 moves along a circular path centered on the upper skew axis 170. The main portion 60 of the first bracket 50 moves about the upper skew axis 170 with the eccentric portion 174 of the hub 65. Moreover, the arcuate lower surface 64 of the first bracket 50 guides the arm portion 62 to rotate in rolling sliding contact with the upper surface 190 of the first wedge 84 when the main portion 60 rotates about the upper skew axis 170. The arcuate lower surface 64 is specifically designed with a radius of curvature that cooperates with the upper surface 190 and with the hub 65 to guide the entire first bracket 50 to move along a circular path centered on the axis 76 of the upper blanket cylinder. The axis 68 of the upper plate cylinder 14 is thus moved along a circular path centered on the axis 76 of the upper blanket cylinder 16 when the upper plate cylinder 14 is skewed. The distance between the axes 68 and 76 therefore remains substantially unchanged when the plate cylinder 14 is skewed. As a result, the surface pressure at the nip 42 remains substantially unchanged when the upper plate cylinder 14 is skewed.

Figure 4:
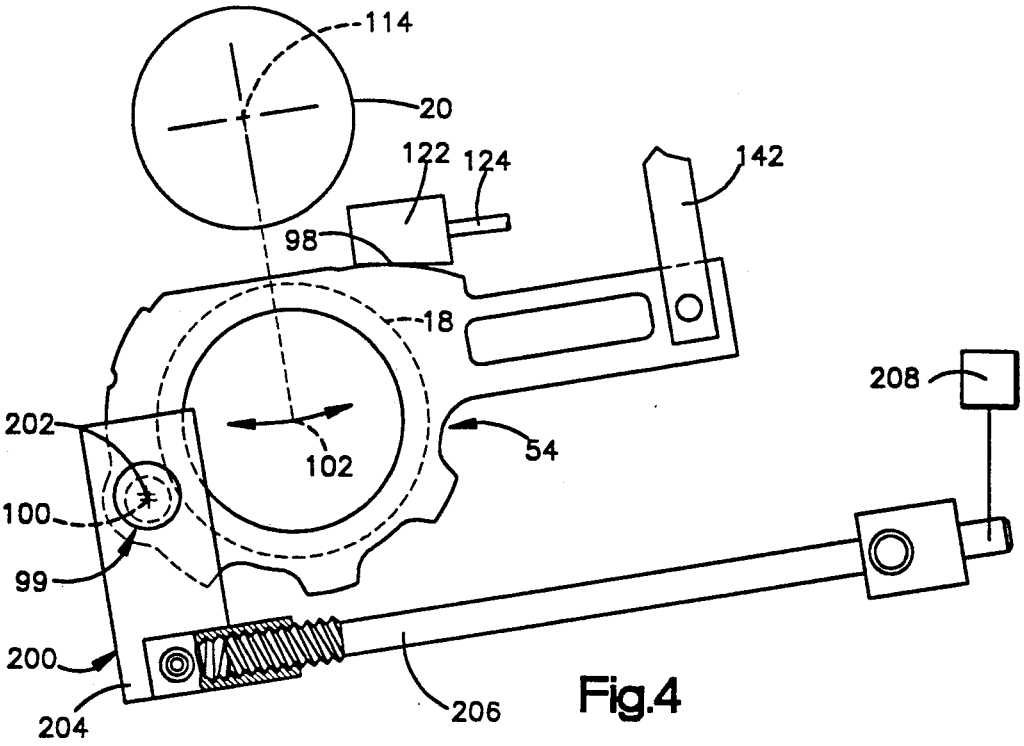
FIG. 4 is another view of parts of the apparatus of FIG. 1.

As shown in FIG. 4, the hub 99 and a skew adjusting mechanism 200 are similarly associated with the lower plate cylinder 18 and the lower blanket cylinder 20. Like the hub 65, the hub 99 defines a lower skew axis 202 in addition to the lower throw-off axis 100. Like the skew adjusting mechanism 180, the skew adjusting mechanism 200 includes a lever 204 and an adjusting bar 206 connected between the side wall 22 and the hub 99. When the adjusting bar 206 is rotated about its longitudinal axis under the influence of a motor 208, the lever 204 and the hub 99 rotate together about the lower skew axis 202. The hub 99 and the third wedge 122 cooperate with the third bracket 54 to move the third bracket 54 transversely relative to the lower blanket cylinder 20 in the same manner that the first bracket 50 moves transversely relative to the upper blanket cylinder 16. The axis 102 of the lower plate cylinder 18, which is supported at one end to move with the third bracket 54, then moves transversely relative to the axis 114 of the lower blanket cylinder 20 along a circular path centered on the axis 114 of the lower blanket cylinder 20. The lower plate cylinder 18 is thus skewed relative to the lower blanket cylinder 20. The pivotal connections between the pressure cylinder 140, the piston rod 142, and the brackets 50 and 54 permit the pressure cylinder 140 and the piston rod 142 to move pivotally relative to the brackets 50 and 54 upon transverse skewing movement of the brackets 50 and 54. The upper and lower plate cylinders 14 and 18 can therefore be skewed independently of each other while remaining connected to each other for throw-off.

From the above description of the invention, those skilled in the art will perceive improvements, changes and modifications. Such improvements, changes and modifications within the skill of the art are intended to be covered by the appended claims.

Having described the invention, the following is claimed:

1. Apparatus comprising:

a frame (22);

a first printing cylinder (14) having an axis of rotation (68);

a bracket (50) supported on said frame (22) for movement relative to said frame (22), said bracket (50) supporting an end of said first printing cylinder (14) for movement with said bracket (50) relative to said frame (22);

a second printing cylinder (16) supported on said frame (22), said second printing cylinder (16) having an axis of rotation (76); and skewing means for changing the angular positions of said first and second printing cylinders (14, 16) relative to each other, said skewing means including a hub (65) supporting said bracket (50) to rotate about a hub axis (170), and a support member (84) having a surface (190) supporting said bracket (50) to move in a direction transverse to said hub axis (170) in sliding contact with said surface (190) of said support member (84);

said skewing means further including means for rotating said bracket (50) about said hub axis (170) and for simultaneously moving said bracket (50) in said transverse direction in sliding contact with said surface (190) of said support member (84).

2. Apparatus as defined in claim 1 wherein said bracket (50) moves said end of said first printing cylinder (14) along a circular path centered on said axis of rotation (76) of said second printing cylinder (16) when said bracket (50) is rotated about said hub axis (170) and is simultaneously moved in said transverse direction in sliding contact with said surface (190) of said support member (84).

3. Apparatus as defined in claim 2 wherein said bracket (50) has a bracket surface (64) abutting said surface (190) of said support member (84), at least one of said surfaces (64, 190) having an arcuate shape which directs said bracket (50) to rotate relative to said support member (84) when said bracket (50) rotates about said hub axis (170) and simultaneously moves in said transverse direction in sliding contact with said surface (190) of said support member (84).

4. Apparatus as defined in claim 3 wherein said bracket surface (64) has said arcuate shape.

5. Apparatus comprising:

a frame (22);

a first printing cylinder (14) supporting a first printing member (30) having a cylindrical printing surface;

a first bracket (50) supported on said frame (22), said first bracket (50) supporting said first printing cylinder (14);

a second printing cylinder (16) supporting a second printing member (34) with a cylindrical printing surface;

a second bracket (52) supported on said frame (22), said second bracket (52) supporting said second printing cylinder (16);

throw-off means supporting said first and second brackets (50, 52) on said frame (22) for movement relative to each other, said throw-off means including means for moving said first bracket (50) relative to said second bracket (52) and thereby to move said first printing cylinder (14) relative to said second printing cylinder (16) between a printing position and a thrown-off position, said first and second printing members (30, 34) being pressed together at a nip (42) between said first and second printing cylinders (14, 16) when said first printing cylinder (14) is in said printing position, said first and second printing members (30, 34) being spaced from each other when said first printing cylinder (14) is in said thrown-off position; and pressure controlling means for controlling the pressure between said first and second printing members (30, 34) when said first and second printing members (30, 34) are pressed together at said nip (42), said pressure controlling means including wedge means movable between said first and second brackets (50, 52) to control the positions of said first and second brackets (50, 52) relative to each other when said first printing cylinder (14) is in said printing position.

6. Apparatus as defined in claim 5 wherein said wedge means comprises a wedge member (84) supported for movement horizontally between said first and second brackets (50, 52) in a direction transverse to the longitudinal axes (68, 76) of rotation of said first and second printing cylinders (14, 16).

7. Apparatus as defined in claim 5 wherein each of said first and second printing cylinders (14, 16) is free of bearers.

8. Apparatus as defined in claim 5 wherein said second bracket (52) is fixed to said frame (22).

9. Apparatus comprising:

a frame (22);

a first bracket (50) supported on said frame (22) for movement relative to said frame (22);

a first printing cylinder (14) with an end supported by said first bracket (50) to move with said first bracket (50);

a second bracket (54) supported on said frame (22) for movement relative to said frame (22);

a second printing cylinder (18) with an end supported by said second bracket (54) to move with said second bracket (54);

skewing means for changing the angular positions of said first and second printing cylinders (14, 18) relative to each other, said skewing means including means for moving said first bracket (50) relative to said frame (22), and means for moving said second bracket (54) relative to said frame (22) independently of movement of said first bracket (50);

throw-off means for moving said first and second printing cylinders (14, 18) toward and away from each other, said throw-off means including motor means for moving said first and second brackets (50, 54) relative to said frame (22); and said motor means being connected between said first and second brackets (50, 54) and including a first output member (140), a second output member (142), and means for moving said first and second output members (140, 142) relative to each other, said first output member (140 being connected to said first bracket (50), said second output member (142) being connected to said second bracket (54).

10. Apparatus as defined in claim 9 wherein said first output member (140) is pivotally connected to said first bracket (50), said second output member (142) is pivotally connected to said second bracket (54), and said output members (140, 142) are movable pivotally relative to said brackets (50, 54) upon movement of said brackets (50, 54) by said skewing means.

11. Apparatus as defined in claim 10 wherein said first output member (140) is a pressure cylinder, and said second output member (142) is a piston rod movable in said pressure cylinder (140) in response to pressure in said pressure cylinder (140).

12. Apparatus as defined in claim 11 further comprising a third bracket (52) fixed to said frame (22), an upper blanket cylinder (16) having an end supported by said third bracket (52), a fourth bracket (56) supported on said frame (22) for movement relative to said frame (22), and a lower blanket cylinder (20) having an end supported to move with said fourth bracket (56), said first printing cylinder (14) being an upper plate cylinder adjacent to said upper blanket cylinder (16), said second printing cylinder (18) being a lower plate cylinder adjacent to said lower blanket cylinder (20).

13. Apparatus as defined in claim 12 wherein said throw-off means moves said second bracket (54) a predetermined amount from a printing position to a thrown-off position, said fourth bracket (56) being supported by said second bracket (54) to move with said second bracket (54) throughout a first portion of said predetermined amount of movement, said second bracket (54) being movable away from said fourth bracket (56) throughout the remainder of said predetermined amount of movement.

14. Apparatus comprising:

a frame (22);

a first printing cylinder (16) supported on said frame (22);

a second printing cylinder (20) supported on said frame (22);

throw-off means for moving said second printing cylinder (20) toward and away from said first printing cylinder (16) between a printing position and a thrown-off position, said throw-off means including means for guiding said second printing cylinder 920) to be moved from one of said positions to the other of said positions by gravity;

a bracket (56) supported on said frame (22) for movement relative to said frame (22), said bracket (56) supporting a portion of the weight of said second printing cylinder (20);

a carrier member 954) supported on said frame (22) for movement relative to said frame (22), said carrier member (54) supporting a portion of the combined weight of said bracket (56)and said second printing cylinder (20);

a motor means (140, 142) for moving said carrier member 954) vertically relative to said frame (22), said carrier member (54) carrying said bracket (56) and said second printing cylinder (20) vertically relative to said frame (22) when said carrier member (54) is moved vertically by said motor means (140, 142); and a third printing cylinder (18) and a limiting means (130), said carrier member (54) supporting said third printing cylinder (18) for movement with said carrier member (54), said limiting means (130) limiting downward movement of said bracket (56) with said carrier member (54), said motor means (140, 142) moving said carrier member (54) downward from said bracket (56) after said limiting means (130) limits downward movement of said bracket (56) with said carrier member (54), said motor means (140, 142) thus moving said third printing cylinder (18) into a position thrown-off from said second printing cylinder (20).

15. Apparatus as defined in claim 14 wherein said first printing cylinder (16) is an upper blanket cylinder, said second printing cylinder (20) is a lower blanket cylinder, and said third printing cylinder (18) is a lower plate cylinder.

16. Apparatus comprising:

a frame (22);

a first printing cylinder (20);

first bracket means for supporting said first printing cylinder 9200 on said frame (22), said first bracket means including a pair of first brackets (56) which are supported on said frame (22) for movement relative to said frame (22) pivotally about a first horizontal axis (110), said first brackets (56) being thus supported to drop pivotally downward under the force of gravity, each of said first brackets (56) supporting a respective end of said first printing cylinder 920) to move said first printing cylinder (20) with said first brackets (56) relative to said frame (22), said first brackets (56) thus bearing the entire weight of said first printing cylinder (20);

a second printing cylinder (18);

second bracket means for supporting said second printing cylinder (18) on said frame (22), said second bracket means including a pair of second brackets (54) supported on said frame (22) for movement relative to said frame (22); pivotally about a second horizontal axis (100), each of said second brackets (54) supporting a respective end of said second printing cylinder (18) to move said second printing cylinder (18) with said second brackets (54) relative to said frame (22); and motor means (140, 142) for moving said second brackets (54) relative to said frame (22) pivotally about said second horizontal axis (100);

each of said first brackets (56) having a lower surface means (122) for resting directly on an upper surface (98) means on a respective one of said second brackets (54) so as to be lifted pivotally upward by said second brackets (54) when said second brackets (54) are moved pivotally upward by said motor means (140, 142), and to drop pivotally downward upon said second brackets (54) when said second brackets (54) are moved pivotally downward by said motor means (140, 142), said lower surface means (1200 on said first brackets (56) applying substantially the entire weight of said first printing cylinder (20) to said upper surface means (98) on said second brackets (54).

* * * * *

UNITED STATES PATENT AND TRADEMARK OFFICE

CERTIFICATE OF CORRECTION

PATENT NO. : 5,301,609

DATED : April 12, 1994

INVENTOR(S) : Glenn A. Guaraldi and James W. Geary

It is certified that error appears in the above-identified patent and that said Letters Patent is hereby corrected as shown below:

Column 11, line 26, change "920)" to --(20)--.

Column 11, line 32, change "954)" to --(54)--.

Column 11, line 38, change "954)" to --(54)--.

Column 12, line 13, change "9200" to --(20)--.

Column 12, line 21, change "920)" to --(20)--.

Column 12, line 49, change "(1200" to --(120)--.

Signed and Sealed this

Fourth Day of October, 1994

*Attest:*

Bruce Lehman

BRUCE LEHMAN

*Attesting Officer*

*Commissioner of Patents and Trademarks*